US006763613B2

(12) United States Patent
Brown

(10) Patent No.: US 6,763,613 B2
(45) Date of Patent: Jul. 20, 2004

(54) FOOT AIRTHOTIC

(76) Inventor: Lawrence Brown, 25511 Van Dyke, Suite 100, Center Line, MI (US) 48015

( * ) Notice: Subject to any disclaimer, the term of this patent is extended or adjusted under 35 U.S.C. 154(b) by 10 days.

(21) Appl. No.: 10/107,959

(22) Filed: Mar. 26, 2002

(65) Prior Publication Data

US 2003/0009911 A1 Jan. 16, 2003

Related U.S. Application Data

(60) Provisional application No. 60/304,986, filed on Jul. 13, 2001.

(51) Int. Cl.[7] ..... A43B 13/38

(52) U.S. Cl. ..... 36/44; 36/140; 36/43

(58) Field of Search ..... 36/29, 43, 44, 36/140, 28, 71

(56) References Cited

U.S. PATENT DOCUMENTS

| | | | | | |
|---|---|---|---|---|---|
| 532,429 | A | * | 1/1895 | Rogers | 36/28 |
| 1,869,257 | A | * | 7/1932 | Hitzler | 36/3 R |
| 3,724,106 | A | * | 4/1973 | Magidson | 36/44 |
| 4,183,156 | A | * | 1/1980 | Rudy | 36/44 |
| 4,521,979 | A | * | 6/1985 | Blaser | 36/29 |
| 5,295,314 | A | * | 3/1994 | Moumdjian | 36/29 |
| 5,311,680 | A | | 5/1994 | Comparetto | |
| 5,313,717 | A | | 5/1994 | Allan et al. | |
| 5,493,791 | A | | 2/1996 | Kramer | |
| 5,517,770 | A | * | 5/1996 | Martin et al. | 36/43 |
| 5,564,202 | A | | 10/1996 | Hoppenstein | |
| 5,867,923 | A | | 2/1999 | Lehneis | |
| 5,894,687 | A | | 4/1999 | Lin | |
| 5,921,009 | A | * | 7/1999 | Hice | 36/140 |
| 5,987,781 | A | | 11/1999 | Pavesi et al. | |

* cited by examiner

*Primary Examiner*—M. D. Patterson
(74) *Attorney, Agent, or Firm*—Kohn & Associates, PLLC

(57) ABSTRACT

According to the present invention, there is provided a foot orthotic including an orthotic base mechanism for underlying a sole of a foot, a first cushioning mechanism, and a second cushioning mechanism. The orthotic base mechanism has a proximal end for underlying a heel of the foot and a distal end for underlying the forefront of the foot. The first cushioning mechanism is operatively connected to the orthotic base mechanism at the proximal end, while the second cushioning mechanism is operatively connected to the distal end of the orthotic base mechanism. Additionally, there is provided a foot orthotic including a first cushioning mechanism and a second cushioning mechanism that are independent of each other. The present invention additionally provides for a method of making the foot orthotic and method of using the foot orthotic disclosed herein.

4 Claims, 4 Drawing Sheets

FOOT AIRTHOTIC

CROSS-REFERENCE TO RELATED APPLICATION

This application claims the benefit of priority under 35 U.S.C. Section 119(e) of U.S. Provisional Patent Application No. 60/304,986 filed Jul. 13, 2001, which is incorporated herein by reference.

BACKGROUND OF THE INVENTION

1. Field of the Invention

The present invention relates to the field of foot orthotics and specifically towards shoe inserts with increased foot support and shock absorption.

2. Description of the Related Art

Various foot and related back problems occur to numerous people. These problems can stem from impact occurring during walking, running, jogging, and other activities. Additionally, because the foot bears the weight of the person during these activities, problems also arise due to a lack of support for the foot and ankle.

Generally, there are two types of "rolling" movement that occur with the foot. First, pronation is the downward rotation or rolling of the foot towards inside or medial side of the foot. Second, supination is the downward rotation or rolling of the foot towards the outside or lateral side of the foot. Although both of these movements normally occur, excessive rotation or rolling is not desired. In fact, excessive rotation causes undesired discomfort, pain, and fatigue, which often lead to chronic trauma of the foot and related anatomy if left uncorrected over time.

Various methods and devices have been developed for use in a variety of shoes in order to seek additional cushioning and shock absorption during impact while walking, running, and other activities. These methods and devices provide some protection to the shoe wearer's foot. This is particularly true in athletic footwear where the foot is exposed to repeated shock from impact during jogging, running and other athletic activities. Additionally, various other methods and devices have been employed in shoes that seek to provide a custom fit of the shoe around the contours of the shoe wearer's foot while still providing support and stability to the foot.

Different types of foot orthotics and related systems have been developed for use with footwear to provide support to the foot to prevent or hinder abnormal or excessive lateral movement. These foot orthotics or support systems have been developed to compensate and correct such abnormal movement. Typically, an orthotic is an orthopedic device designed to protect, support, align, prevent, correct, restore, or improve the function of the foot. In this case, the orthotic is typically used to treat abnormal pronation or rolling of the foot. Although pronation of the foot usually occurs to most people, an abnormal range of pronation is not desired. Thus, various orthotics have been developed to prevent or at least reduce any abnormal pronation.

An example of such an orthotic is disclosed in U.S. Pat. No. 5,311,680 to Comparetto discloses a foot supporting orthotic having parallel, separately flexing rays extending forwardly from an arch region that in use underlies the arch of a wearer's foot. The rays are bowed by spring-like elastomers and facilitate the shock absorbing and adaptation stages of walking.

U.S. Pat. No. 5,867,923 to Lehneis discloses a sole for a shoe that is constructed with a relatively rigid top layer or insole and a relatively rigid bottom layer or outsole which are mounted for relative rotation about an axis perpendicular to and extending through the center of the sole. Between the insole and outsole, there is provided a relatively yieldable elastomer layer, which permits relative rotation between the insole and the outsole upon rotation of the foot during walking, but will resiliently restore the insole and outsole to an aligned position when the torsional force of the foot is removed.

In addition to providing added support or stability to the foot, there are prior art devices that have been developed to provide added cushioning and custom fit to the foot. These devices are constructed to provide a softer shoe sole by utilizing softer, more resilient material. Further, these devices incorporate fluid filled pads or bladders in the sole of the shoe.

Often times, in providing additional cushioning in the shoe sole, these types of shoes sacrifice or reduce the support and stability provided to the foot by the shoe sole. In particular, shoe soles that employ fluid filled pads or bladders to provide cushioning to the foot are often incapable of providing cushioning to the foot for all of the varying magnitudes of force exerted on the foot and the varying areas of the foot subjected to the forces in footstep impacts in jogging, running, and other athletic activities. Typical fluid filled pads or bladders are usually designed to provide cushioning in the particular area of the shoe sole where the latter is located. For example, pads or bladders are located in the heel or the forefoot areas of the shoe sole. Many prior art fluid filled pads or bladders are effective in providing cushioning to the foot only when the force of the footstep impact is concentrated at the center of the fluid filled pad or bladder. Should forces from the footstep impact occur along the outer or inner edge of the runners foot, as is often the case, the footstep impact forces exerted on the outer or inner edges of the prior art fluid filled pads or bladders often cause the fluid to be forced from these areas to other areas of the pads or bladders. With the fluid having been forced from the outer or inner areas of the pads or bladders, these pads or bladders are incapable of providing any cushioning of the force of footstep impact along the outer or inner edges of the foot.

Various patents existing in the art disclose the use of an insert that can be placed inside of a shoe for providing cushioning support. For instance, U.S. Pat. No. 5,313,717 to Allan et al., discloses the use of bladders that are filled with fluid to support the forefoot and the heel areas. These bladders are connected by fluid connecting channels and are therefore in fluid communication with each other. This insert however, can only be used with shoes that are constructed to have recess cavities capable of containing therein these bladders. Absent these cavities, the bladders cannot function properly.

U.S. Pat. No. 5,493,791 to Kramer, discloses the use of plugs that are disposed on the insole, wherein each plug is compressible, thereby conforming the insole to the shape of the individual's foot who is wearing the insert. A limitation of the Kramer patent is that it does not include air pockets. Absent these air pockets, a shoe cannot be comfortable if the plugs do not compress in the proper conformation.

U.S. Pat. No. 5,564,202 to Hoppenstein, discloses the use of an insert utilizing gas filled and gel filled cells, which alternate such that when the pressure is on one cell, the other cell will move. As a result, the insole will be conforming to the shape of the individual's foot. Additionally, U.S. Pat. No. 5,987,781 to Pavesi et al., discloses a footpad, which includes a plurality of inserts that have an elastic response to pressure. The insert includes the formable elements that are positioned throughout the pad.

Finally, U.S. Pat. No. 5,894,687 to Lin, discloses a shoe pad having a massage effect that includes utilizing a plurality of bulbs that are evenly distributed over the upper surface of the insert. These bulbs are filled with air and are compressible. Also included with the shoe pad however, are cells that are in fluid communication with one another. The cells are located at both the heel of the pad and where the ball of the foot would be located also. This fluid communication allows air or other fluid to pass between the two sections such that there is pressure distributed between the two.

Although there are numerous inserts that exist in the art, they all have their drawbacks. Accordingly, there is a need for a footpad or foot orthotic that utilizes cushioning pockets in order to provide added support and shock absorption. Such a device results in decreased foot pain and back pain. Moreover, such a device will aid in the treatment and prevention of related foot, joint, and back pains.

SUMMARY OF THE INVENTION

According to the present invention, there is provided a foot orthotic including a base mechanism for underlying a sole of a foot, a first cushioning mechanism, and a second cushioning mechanism. The orthotic base mechanism is any type of foot orthotic that includes a proximal end for underlying a heel of the foot and a distal end for underlying the forefront of the foot. The first cushioning mechanism is operatively connected to the orthotic base mechanism at the proximal end, while the second cushioning mechanism is operatively connected to the distal end of the orthotic base mechanism. Additionally, there is provided a foot orthotic including a first cushioning mechanism and a second cushioning mechanism that are independent of each other. The present invention additionally provides for a method of making the foot orthotic and method of using the foot orthotic disclosed herein.

DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
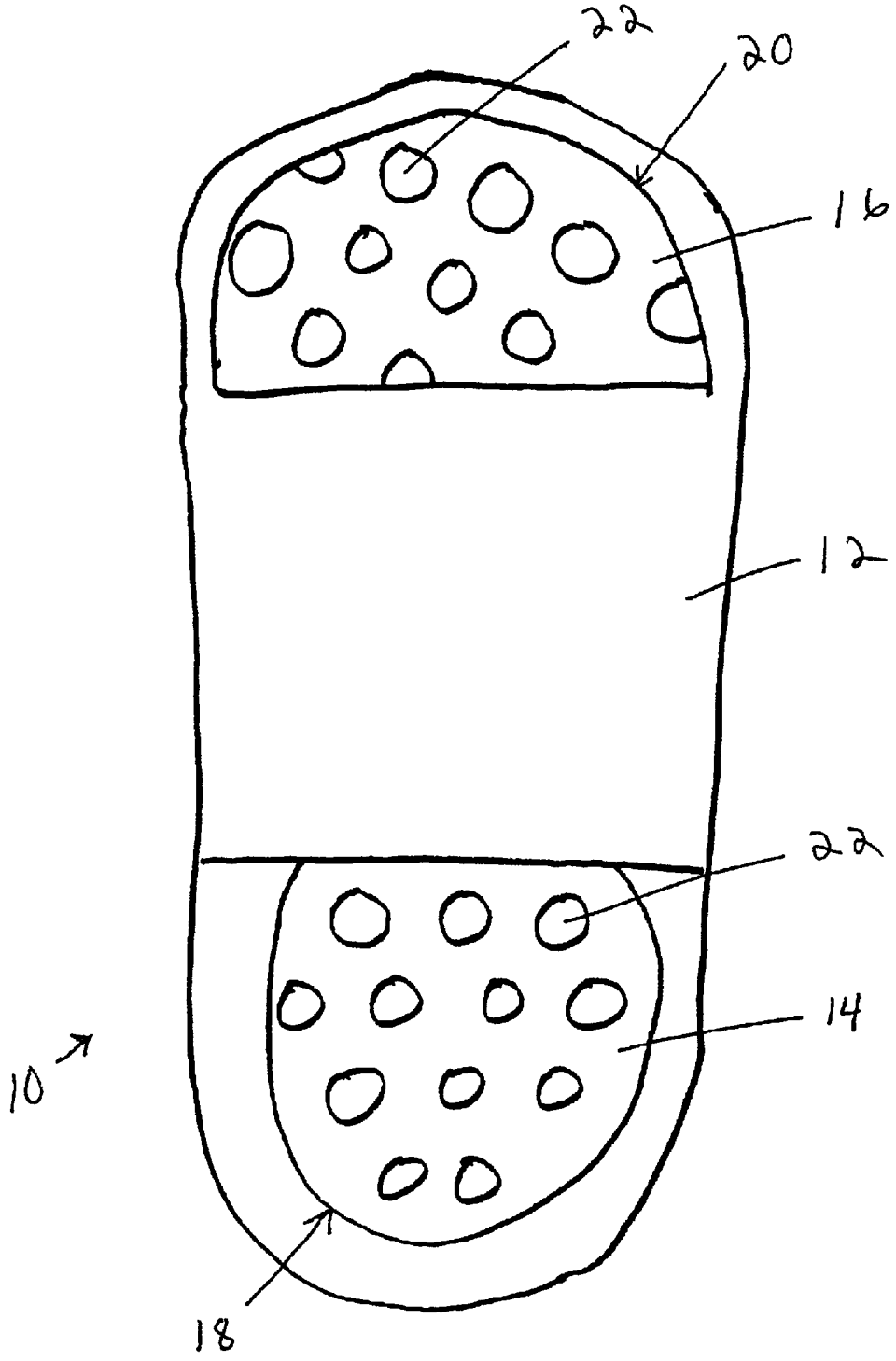
FIG. 1 is a bottom view of an embodiment of the foot orthotic of the present invention.
Figure 2:
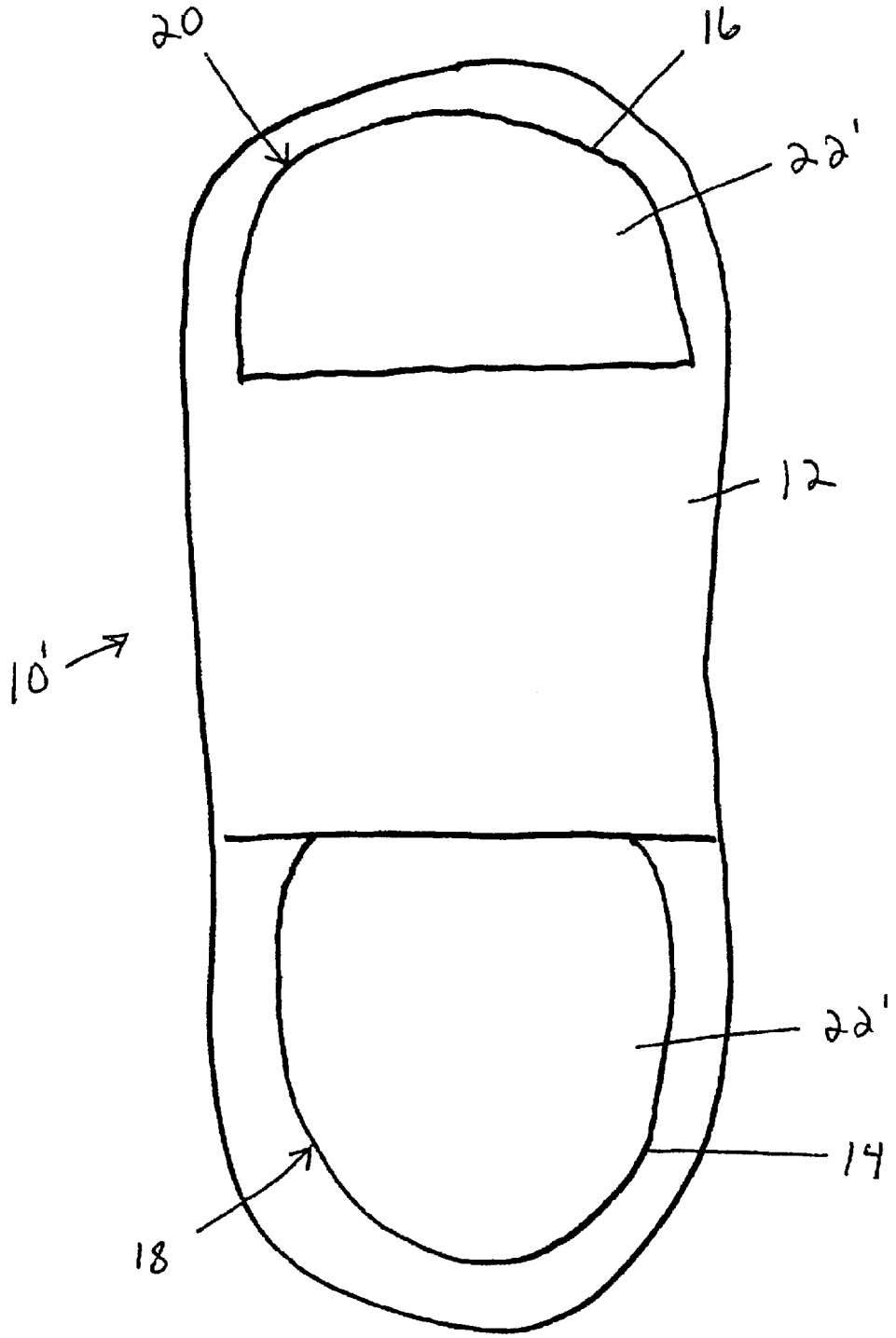
FIG. 2 is a bottom view of another embodiment of the foot orthotic of the present invention.
Figure 3:
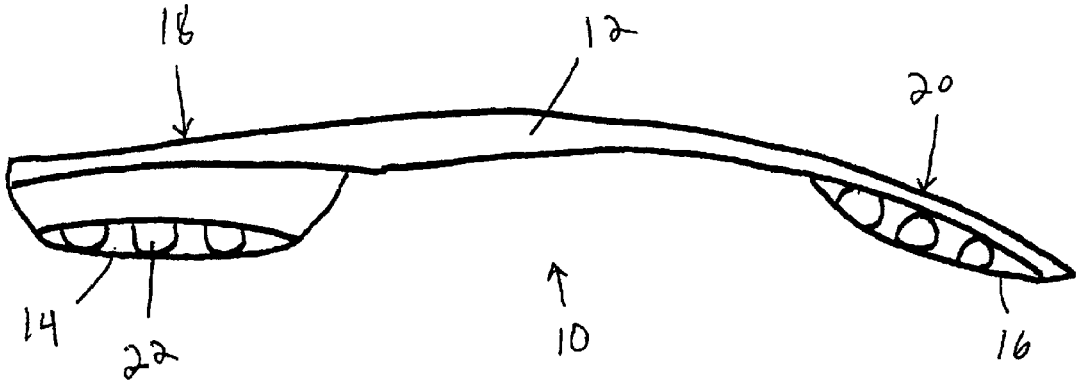
FIG. 3 is a perspective, side view of an embodiment of the foot orthotic of the present invention.
Figure 4:
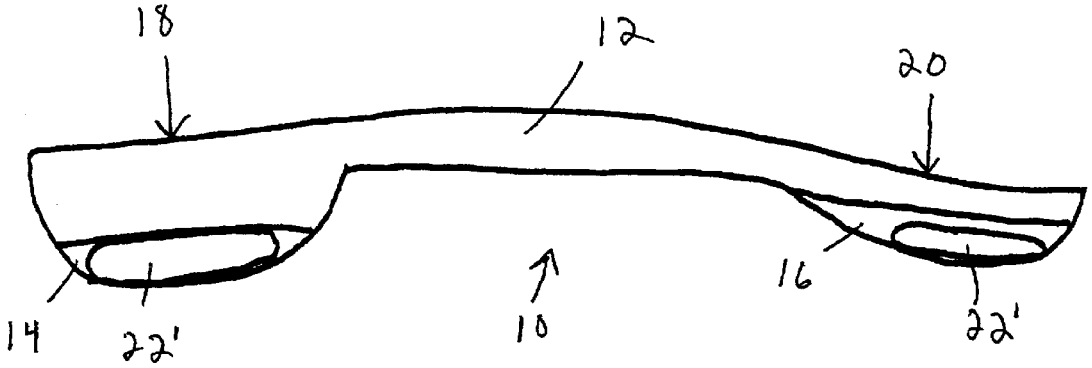
FIG. 4 is a perspective, side view of another embodiment of the foot orthotic of the present invention, wherein air pockets are utilized in the first and second cushioning mechanisms therein.
Figure 5:
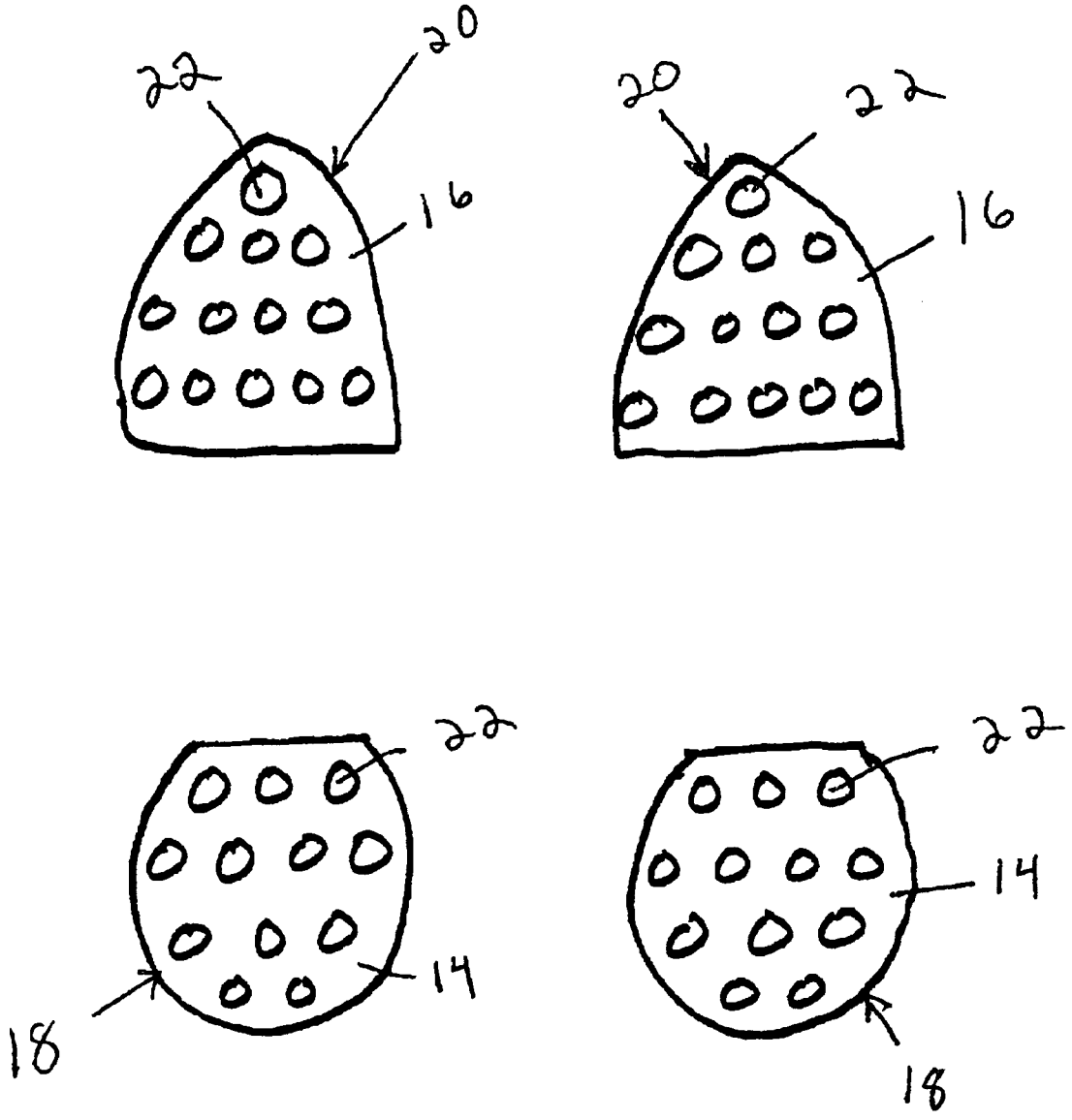
FIG. 5 is a bottom view of an embodiment of the first and second cushioning mechanisms for placement in the forefront and heel of the foot respectively.

The present invention is a foot orthotic generally indicated by 10 in the figures. While specific embodiments are disclosed herein, they are not exhaustive and can include other suitable designs that are more compact, lightweight and/or durable. Moreover, such designs vary in terms of size and types of structures used to provide support, protection, shock-absorption, and/or cushioning to a person's foot. Basically, any differing design, structures, and composite materials known to those of skill in art can be utilized without departing from the spirit of the present invention.

The present invention provides for a foot orthotic device that limits or prevents the amount of abnormal pronation or supination of the foot while providing shock-absorption to foot. The molding and control of the foot orthotic of the present invention provides support to the foot. The cushioning of the present invention provides added comfort and shock-absorption of any impact placed upon the foot. Thus, the combination of both the foot orthotic and cushioning relieves, treats, and prevents foot, joint, and back pain.

The terms "foot orthotic," "orthotic," and "orthotic base mechanism" as used herein are defined as, but are not limited to, any type of footstep device or apparatus that provides added support to the foot so that abnormal movement, such as abnormal pronation or supination, is prevented. Typically, these devices provide support in the arch of the foot, but other types of designs also exist. There are numerous orthotics known to those of skill in the art and can be manufactured by numerous methods known in the art.

In one embodiment, the present invention provides for a foot orthotic 10 including an orthotic base 12 for underlying a sole of a foot wherein the orthotic base 12 has a proximal end 14 for underlying the heel of the foot and a distal end 16 for underlying the forefront or ball of the sole of the foot. The foot orthotic 10 further includes a first cushioning mechanism 18 for providing cushioning and shock absorption underlying and operatively connected to the orthotic base 12 at the proximal end 14. Additionally, the foot orthotic 10 includes a second cushioning mechanism 20 for providing cushioning and shock absorption underlying and operatively connected to the orthotic base mechanism 10 at the distal end 16 thereof.

The orthotic base 12 is any type of known foot orthotic or base mechanism 12 for lining and inserting into any type of shoe that is known to those of skill in the art. The orthotic base 12 provides support for the foot and an anchoring base for the first cushioning mechanism 18 and second cushioning mechanism 20. The orthotic base 12 varies in design, size, and weight. Thus, various thickness of material can be used depending upon the amount and type of absorption desired. For instance, the thickness can be approximately one to two centimeters thick. The orthotic base 12 is made of materials including, but not limited to, hardened plastic, cork, foam, metal, polypropylene material, plastic, rubber, cloth, combinations thereof, and any other similar material known to those of skill in the art. The orthotic base 12 can also include an arch support with a specific height or thickness, preferably one to two centimeters. Of course, a much higher arch design can also be utilized. The size of the orthotic base 12 also varies in shoe size for both men and women.

The first cushioning mechanism 18 and second cushioning mechanism 20 are independent of each other and independently attached to the orthotic base 12 at the proximal end 14 and distal end 16 respectively. There are numerous methods and materials that can be utilized to attach these cushioning mechanisms 18,20 known to those of skill in the art. For instance, the cushioning mechanisms 18, 20 can be attached through adhesives, stitches, hook and loop systems, and any other similar methods and materials known to those of skill in the art.

This first cushioning mechanism 18 and the second cushioning mechanism 20 are similar in that they utilize at least one chamber 22 for providing the additional cushioning and shock absorption effects desired. This chamber 22 is either filled material or fluid. Such material includes, but is not limited to, rubber, cloth, foam, cork, and any other similar material known to those of skill in the art. As for the fluid that can be utilized within the chamber 22, these fluids include, but are not limited to, air, carbon dioxide, nitrogen, helium, inert gases, gels, liquids, combinations thereof, and any other similar fluids known to those of skill in the art. These cushioning mechanism 18, 20 cover at least a portion of the proximal and distal ends 14, 16 of the orthotic base 12.

The chambers 22 of the first and second cushioning mechanisms 18, 20 can be one single independent chamber. Additionally, there can be a plurality of chambers 22 depending on the design of the present invention. The chambers 22 do not have to be completely covering the entire surface of the proximal and distal ends 14, 16 of the orthotic base mechanism 12. Moreover, these chambers 22 can also be fluid pockets, fluid bladders, cushioning pads, and fluid cells.

The first and second cushioning mechanisms 18, 20 are independent of each other and are not in fluid communication therebetween. As a result, there is no cushioning or shock absorbing effect that is created in the area between the proximal 14 and distal 16 ends of the orthotic base mechanism 12. In other words, no shock absorption or cushioning occurs in the area where the arch of the foot is located.

The foot orthotic 10 disclosed herein can be inserted into all types of shoes. The foot orthotic 10 can be a single molded piece having a portion that is not foamed, which is a rigid support in a portion that is foamed that provides cushioning and added shock absorption.

The foot orthotic 10 disclosed herein is made by cutting the desired amount of material needed to make the orthotic base mechanism 12. Then, the first and second cushioning mechanisms 18, 20 are securely fastened to the orthotic base mechanism 12. Fastening can be performed and accomplished through various methods known to those of skill in the art that include, but are not limited to, stitching, adhesion with various types of glues, utilization of hook and loop mechanisms, and any other similar methods known to those of skill in the art. The cushioning mechanisms 18, 20 include at least one chamber 22 as described above. The chamber 22 can be created by injecting a fluid into a matrix that is made from materials including, but not limited to, plastic, rubber, or gel. The injection of the fluid can also be done into a gelatinous type matrix in order to provide additional cushioning.

The present invention can be utilized in numerous applications and settings. The present invention is useful within any type of shoe that is used in walking, running, jogging, and any other athletic activities. Moreover, the present invention can be used with currently existing shoe types or be integrated directly into new shoes that are to be produced.

Throughout this application, various publications, including United States patents, are referenced by author and year and patents by number. Full citations for the publications are listed below. The disclosures of these publications and patents in their entireties are hereby incorporated by reference into this application in order to more fully describe the state of the art to which this invention pertains.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention can be practiced otherwise than as specifically described.

What is claimed is:

1. A foot orthotic comprising:

rigid orthotic base means for preventing abnormal pronation and supination of a foot and underlying the sole of the foot, said rigid orthotic base means including a proximal end for underlying the heel of the foot and a distal end for underlying the forefront of the sole of the foot;

first cushioning means operatively connected, underlying, and covering at least a portion of said proximal end of said rigid orthotic base means for providing cushioning and shock absorption; and second cushioning means operatively connected, underlying, and covering at least a portion of said distal end of said rigid orthotic base mechanism for providing cushioning and shock absorption.

2. The foot orthotic according to claim 1, wherein said first and said second cushioning means further including at least one chamber selected from the group consisting of fluid pockets, a fluid bladder, cushioning pads, and fluid cells.

3. The foot orthotic according to claim 2, wherein said fluid is selected from the group consisting of air, carbon dioxide, nitrogen, helium, inert gases, gels, liquids, and combinations thereof.

4. The foot orthotic according to claim 1, wherein said first and second cushioning mechanisms are made from material selected from the group consisting of foam, rubber, and cork.

* * * * *